US007942028B2

(12) United States Patent
Gillest et al.

(10) Patent No.: US 7,942,028 B2
(45) Date of Patent: May 17, 2011

(54) FORMATION OF A CURL IN A UNITARY CLOSABLE CONTAINER

(75) Inventors: Kevin Gillest, Arvada, CO (US); Andrew Le, Westminster, CO (US); Harold Cook, Jr., Evergreen, CO (US); Michael L. Atkinson, Lafayette, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 711 days.

(21) Appl. No.: 12/015,480

(22) Filed: Jan. 16, 2008

(65) Prior Publication Data

US 2008/0168818 A1 Jul. 17, 2008

Related U.S. Application Data

(60) Provisional application No. 60/880,682, filed on Jan. 16, 2007.

(51) Int. Cl.
*B21B 19/14* (2006.01)
*B21D 15/04* (2006.01)

(52) U.S. Cl. ..... 72/105; 72/96; 72/124

(58) Field of Classification Search ..... 72/103, 72/92, 94, 96, 105, 112, 114, 120, 121, 124, 72/379.4, 370.04, 370.01; 413/1, 2, 4, 6, 413/69

See application file for complete search history.

(56) References Cited

U.S. PATENT DOCUMENTS

| | | | | |
|---|---|---|---|---|
| 3,995,572 | A | 12/1976 | Saunders | |
| 4,341,103 | A * | 7/1982 | Escallon et al. | 72/70 |
| 4,574,607 | A * | 3/1986 | Akino et al. | 72/112 |
| 5,293,765 | A | 3/1994 | Nussbaum | |
| 5,557,963 | A | 9/1996 | Diekhoff | |
| 5,572,893 | A | 11/1996 | Goda | |
| 5,704,240 | A | 1/1998 | Jordan | |
| 5,718,352 | A | 2/1998 | Diekhoff et al. | |
| 5,755,354 | A | 5/1998 | Lang | |
| 5,778,723 | A | 7/1998 | Diekhoff | |
| 5,947,309 | A | 9/1999 | Anderson | |
| 6,010,026 | A | 1/2000 | Diekhoff et al. | |
| 6,010,028 | A | 1/2000 | Jordan et al. | |
| D442,865 | S | 5/2001 | Lang | |
| 6,543,636 | B1 | 4/2003 | Flecheux et al. | |
| 6,779,677 | B2 | 8/2004 | Chupak | |
| 6,857,304 | B2 | 2/2005 | Enoki | |
| 6,959,830 | B1 | 11/2005 | Kanou et al. | |
| 2004/0256346 | A1 | 12/2004 | Becker et al. | |
| 2007/0249424 | A1 | 10/2007 | Marshall et al. | |

FOREIGN PATENT DOCUMENTS

| | | | |
|---|---|---|---|
| GB | 827115 | | 3/1960 |
| JP | 62039217 | A * | 2/1987 |
| WO | 2007123716 | | 11/2007 |

* cited by examiner

*Primary Examiner* — Debra M Sullivan

(74) *Attorney, Agent, or Firm* — Grant E. Coffield, Esquire; Eckert Seamans Cherin & Mellott, LLC

(57) ABSTRACT

Disclosed is a device and method for forming a curl in a closable container. A process of forming a pre-curl is used, which is followed by a second separate step of forming the completed curl. The two-step process provides for higher tolerances with respect to the shape of the curl that allows the curl to be used as a sealing surface for a recloseable metal bottle. A three-step process provides for even greater tolerances and reduces longitudinal forces by completing the curl using lateral forces.

2 Claims, 12 Drawing Sheets

FORMATION OF A CURL IN A UNITARY CLOSABLE CONTAINER

CROSS REFERENCE TO RELATED APPLICATION

This application is based upon and claims the benefit of U.S. provisional application No. 60/880,682, entitled "FORMATION OF A CURL IN A UNITARY METAL BOTTLE," filed Jan. 16, 2007, the entire disclosure of which is herein specifically incorporated by reference for all that it discloses and teaches.

BACKGROUND OF THE INVENTION

Forming operations of metal cans have been used for many years. Necking operations are known to harden the metal material, especially when multiple necking operations are used to decrease the diameter of the opening in the can. Recently, similar processes have been used to form metal bottles and other closable containers. Unique problems are encountered in the formation of metal bottles because of the large number of necking procedures that are required to create the smaller opening of a metal bottle.

SUMMARY OF THE INVENTION

The present invention may therefore comprise a process for forming a pre-curl in the neck of a closeable container comprising: providing an internal form plug having a pre-curl groove that substantially matches a desired shape for a pre-curl; providing an external forming device that has a form roller having a lip that engages the pre-curl groove of the internal form plug; placing the internal form plug into an opening in the neck of the closable container against an interior surface of the neck of the closable container at a position on the neck of the closable container where the pre-curl is to be formed; moving the external forming device so that the lip of the form roller engages an exterior surface of the neck of the closable container and is substantially aligned with the pre-curl groove of internal form plug; rotating the closable container and the form roller to form the pre-curl in the neck of the closable container; cutting the neck of the closable container along the pre-curl.

The present invention may further comprise a system for forming a pre-curl in the neck of a closable container comprising: an internal form plug that is inserted in an opening of the neck of the closable container, the internal form plug having a pre-curl groove that substantially matches a desired shape of a pre-curl; an external forming device that has a form roller with a lip that engages an exterior surface of the neck of the closable container and is aligned with the pre-curl groove to form a pre-curl in the neck of the closable container; a cutter that engages the pre-curl and cuts the neck of the closable container at the pre-curl and removes the neck from the pre-curl.

DETAILED DESCRIPTION

Figure 1:
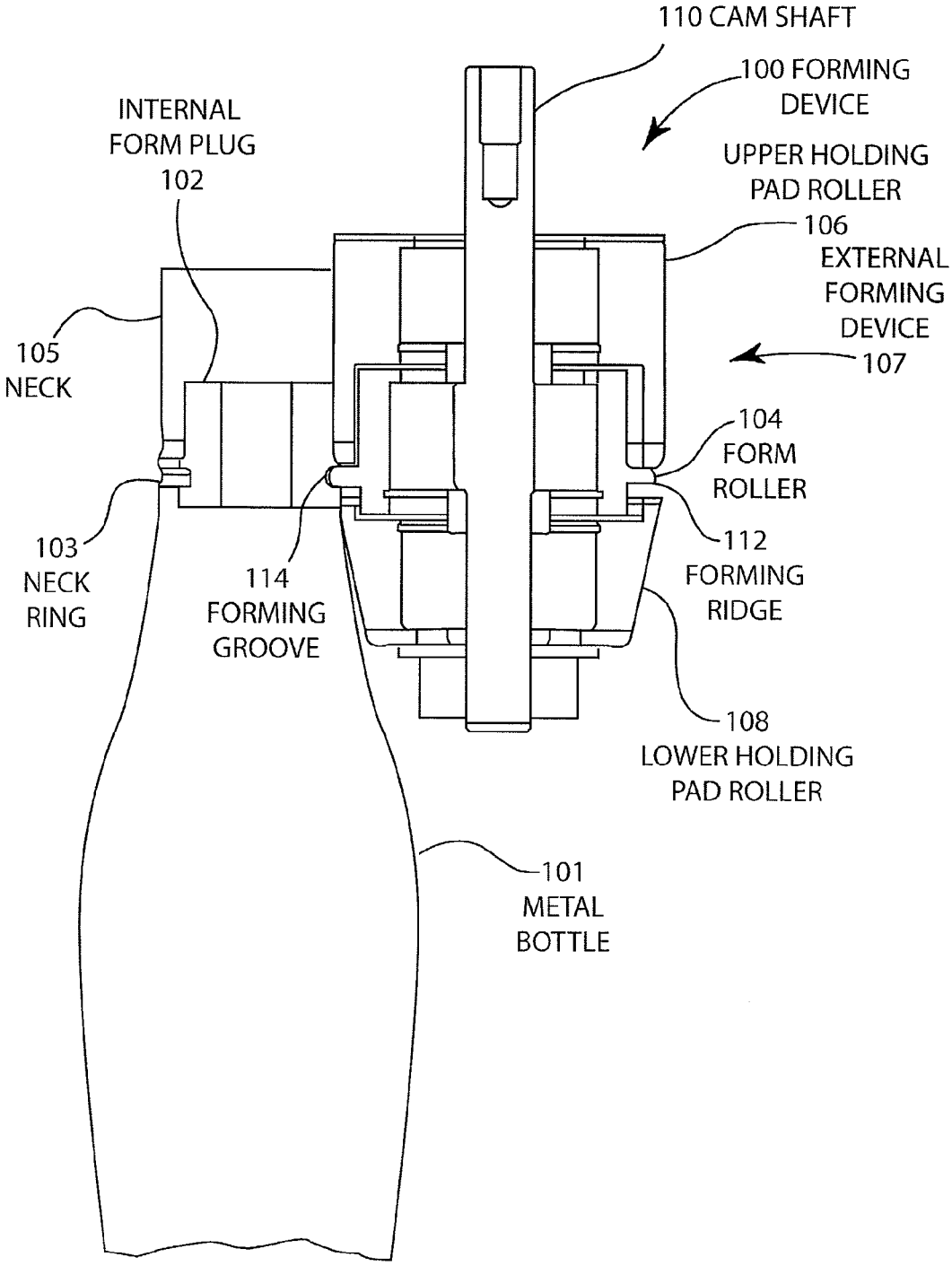
FIG. 1 illustrates the process of forming a neck ring.

FIG. 1 illustrates a forming device 100 for forming a neck ring 103 in a metal bottle 101. Although FIG. 1, as well as other figures, disclose a metal bottle, the processes for forming a curl that are disclosed herein, can be used on various types of closable containers, including threaded containers that have threaded caps, containers that are closable with a crown, containers that have lugs that are closable with a cap, etc. As shown in FIG. 1, the neck ring 103 comprises the first ring when moving vertically upward along the surface of the bottle to the neck and provides structure and stability for the neck 105 of the metal bottle 101. An internal form plug 102 is used in conjunction with the external forming device 107 to form the neck ring 103.

In operation, the metal bottle 101 is loaded into a station (not shown) that has a rotating base plate (not shown) but known to those skilled in the art. The internal form plug 102 is then inserted in the opening at the top of the bottle 101. The internal form plug 102 is moved vertically to the proper height inside neck 105. The internal form plug 102 is then moved horizontally towards the external forming device 107 until the internal form plug 102 contacts the inside of the neck 105 of the metal bottle 101. The external forming device 107 is moved horizontally towards the bottle neck and internal form plug 102 until the upper holding pad roller 106 and the lower holding pad roller 108 are in contact with the side of the metal bottle 101.

To form the neck ring 103 as shown in FIG. 1, a form roller 104, that is part of the external forming device 107, has a forming ridge 112 that mates with a forming groove 114 in the internal form plug 102. Cam shaft 110 then rotates so that the eccentric form roller 104 causes the forming ridge 112 to push inwardly into the forming groove 114 on the internal form plug 102 to form the neck ring on the neck 105 of the metal bottle 101 as metal bottle 101 rotates in the station. After the neck ring 103 is formed in neck 105 of metal bottle 101, the external forming device 107 is moved horizontally away from the bottle. Internal form plug 102 is also moved horizontally away from the side of the neck 105 and pulled upwardly from the opening in the metal bottle 101. The formation of the neck ring is then complete.

Figure 2:
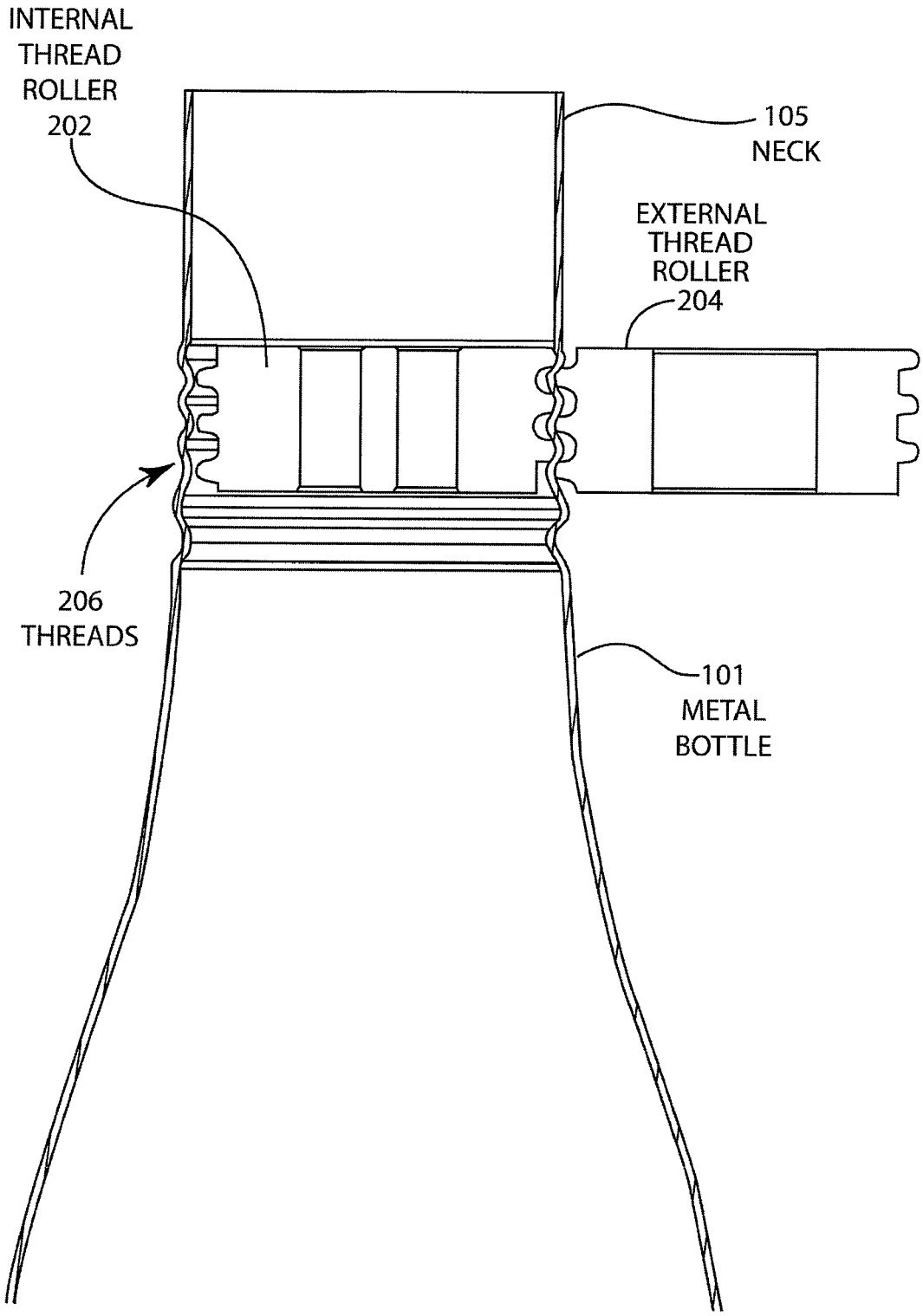
FIG. 2 illustrates the process of forming threads.

FIG. 2 illustrates the process performing threads in the neck 105 of the metal bottle 101. The metal bottle 101 is loaded into a station (not shown) having a rotating base for forming the threads in the neck 105 of the metal bottle 101. An internal thread roller 202 is then inserted in the opening of the neck 105 and moved to the proper height for formation of the threads 206. The internal thread roller 202 then moves horizontally until it touches the inside surface of the neck 105. An external thread roller 204 moves horizontally towards the bottle until it contacts the neck 105 of the metal bottle 101. The external thread roller 204 then slowly moves towards the internal thread roller 202 as the metal bottle 101 is rotated and the external thread roller 204 is rotated so that the threads 206 are formed in the neck 105 of the metal bottle 101 when the ridges of the external thread roller 204 engage the grooves in the internal thread roller 202. The external thread roller 204 is then moved horizontally away from the bottle, and the internal thread roller 202 is moved away from the internal surface of the neck 105 and removed from the metal bottle 101.

Figure 3:
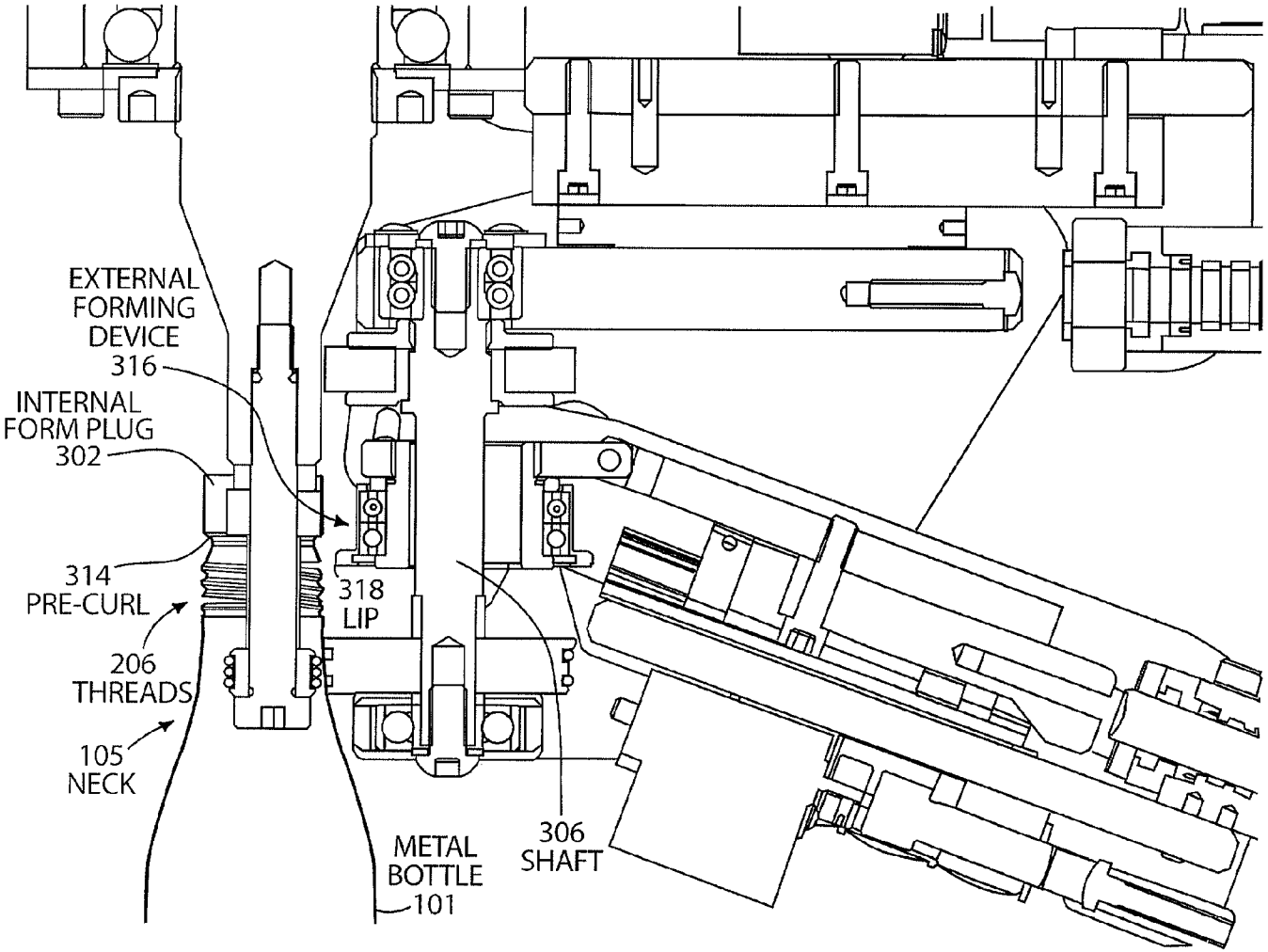
FIG. 3 illustrates the process of forming a pre-curl.

FIG. 3 illustrates the process for forming a pre-curl 314 in the neck 105 of the metal bottle 101. The metal bottle 101 is first moved into a station (not shown) for forming the pre-curl that includes a rotating base (not shown). An internal form plug 302 is inserted into the opening in the neck 105 of the metal bottle 101 and moved to the proper height for forming the pre-curl. The internal form plug 302 is then moved horizontally to the right until it contacts the inside of the neck 105. An external forming device 316 is then used in conjunction with the internal form plug 302 to form the pre-curl 314. The external forming device 316 includes a shaft 306. The external forming device 316 is moved inwardly towards the bottle neck and upwardly to a position above the threads 206 until the external forming device 316 contacts the side of the metal bottle. Shaft 306 then rotates to rotate the metal bottle 101 which allows the lip 318 of the external forming device 316 to engage the neck 105 of the metal bottle 101 in the groove of the internal form plug 302 to form roll and create the pre-curl 314.

The pre-curl 314 is a partially formed curl that extends outwardly in nearly a horizontal direction away from the neck 105 of the metal bottle 101. The formation of the pre-curl 314 allows the metal in the neck 105 to be formed in a partially curled configuration that has less spring back than if a complete curl was formed in one single operation. If a full curl were to be formed in one operation, the formation of the full curl would have to be overdone or over-curled to ensure that the curl was properly formed as a result of spring back. The tolerances of the top surface of a curl that is fully formed in a single operation may be less than desirable as a result of the curl being over-formed or over-curled and then sprung back to a proper position. By forming a pre-curl, there is clearly less spring back that occurs in both the initial pre-curl and final curl process, as disclosed with respect to FIG. 5. The two-step process of forming a pre-curl and then forming a final curl therefore provides for a greater design capability and produces close tolerances as to the shape and flatness of the curl. Of course, the two-step process also allows the second step to modify or correct imperfections in the first step, which further provides for closer tolerances in the final curl.

Other ways of forming the pre-curl may include multiple necking operations. For example, six to eight necking operations may be required to form the pre-curl. However, such processes are expensive and require many steps. In addition, such processes include a substantial amount of work hardening of the metal. In that regard, the roll forming process, illustrated in FIG. 3, is a single step process that is simpler, less expensive and works the metal in the neck 105 to a much lesser extent than multiple necking operations. In addition, the one-step process of roll forming the pre-curl 314 eliminates numerous trimming stages that may be required when multiple necking operations are performed.

Figure 4:
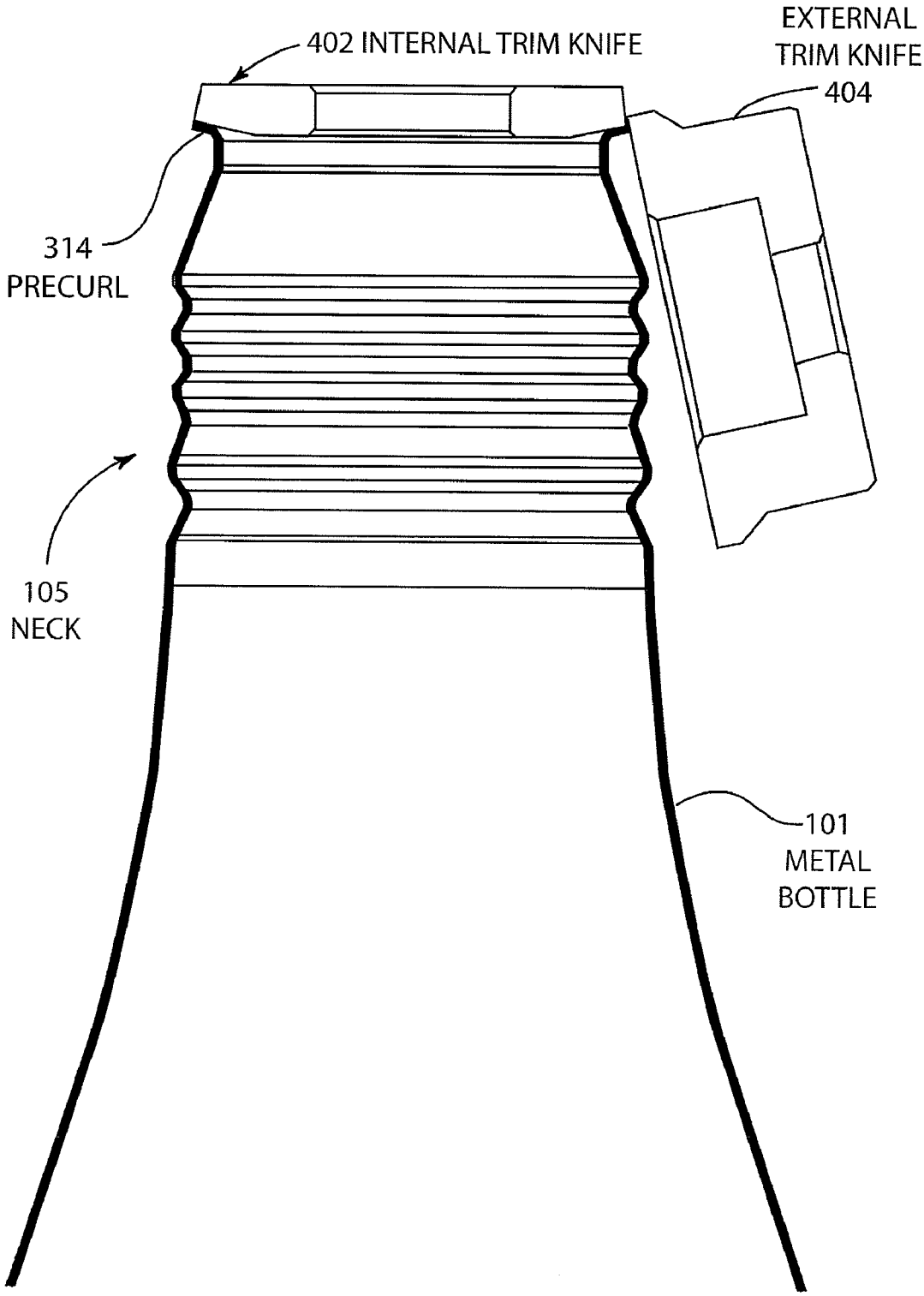
FIG. 4 illustrates the process of trimming the pre-curl scrap ring.

The process of forming a pre-curl in the neck as shown in FIG. 3 also allows the upper portion of the neck 105 to be cut away from the pre-curl in a single step, as illustrated with respect to the description of FIG. 4. This allows the upper portion of the neck 105 to be used, if desired, in the manner disclosed in U.S. patent application Ser. No. 11/468,911, filed Aug. 31, 2006, by Christopher J. Olson, entitled Recloseable Metal Bottle, which is specifically incorporated herein by reference for all that it discloses and teaches. U.S. patent application Ser. No. 60/823,122, filed Aug. 22, 2006, by Christopher J. Olson, entitled Metal Bottle Seal, is also specifically incorporated herein by reference for all that is discloses and teaches. Further, the formation of the pre-curl 314 in a continuous neck 105, as opposed to a pre-cut piece, also helps in stabilizing the formation of the pre-curl which further aids in obtaining the closer tolerances in the final curl.

FIG. 4 schematically illustrates the process of trimming the pre-curl scrap ring. Metal bottle 101 is initially loaded into a station having a rotating base. An internal trim knife 402 is then placed in the opening in the neck 105 of the bottle. The internal trim knife 402 is then moved vertically to the proper position at which a cut is to be made. The internal trim knife 402 is then moved horizontally until it contacts the interior surface of the pre-curl 314. An external trim knife 404 is then moved in a slight upward angle to pierce through the edge of the pre-curl adjacent to the internal trim knife 402. The bottle is then rotated in the neck 105 adjacent to the pre-curl 314 and is cut to produce a scrap ring that is removed from the station.

Figure 5:
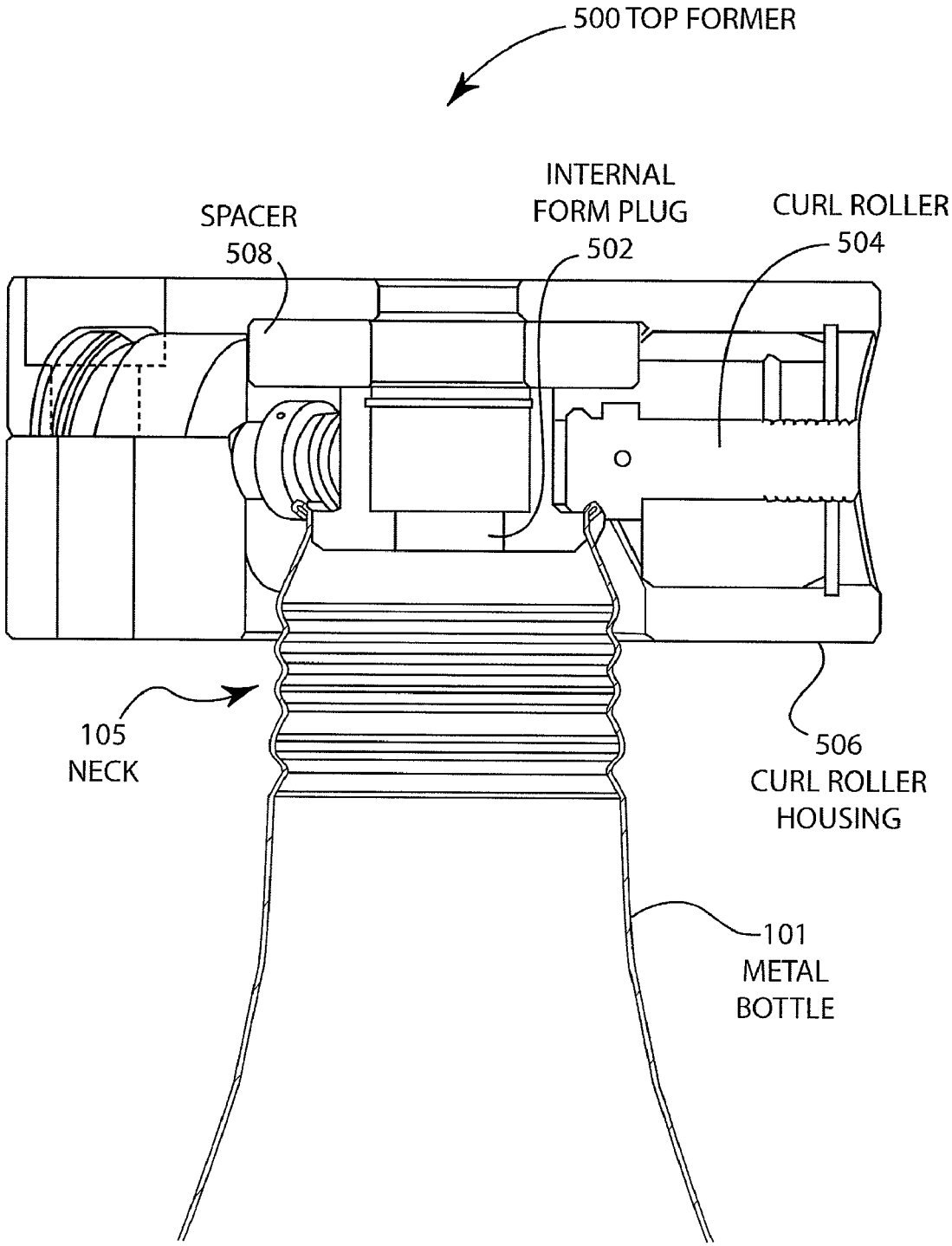
FIG. 5 illustrates the process of completing the curl on the top of the metal bottle.

FIG. 5 is a schematic illustration of a top former 500 for completing the curl at the top of the metal bottle 101. Again, the bottle is loaded into a station having a rotating base, and an internal form plug 502 is inserted into the opening in the neck of the metal bottle 101. The internal form plug 502 is then moved vertically to the proper height for forming the completed curl on the top of the neck 105 of the metal bottle 101. External curl rollers, such as external curl roller 504, is then positioned over the pre-curl 314, as illustrated in FIG. 4. The curl roller 504 is disposed within a curl roller housing 506 which is moved vertically with respect to the internal form plug 502 as the final curl is formed at the end of the neck 105 of the metal bottle 101. The curl roller 504, as well as the other curl rollers, has a groove that is positioned directly over the pre-curl. The curl roller 504 is then moved in a downward direction as the bottle is rotated so that the groove in the curl roller 504 engages the pre-curl 314 and folds the pre-curl in a downward direction to complete the final curl at the top edge of the neck 105 of the metal bottle 101. Spacer 508 locates the curl roller housing 506 with respect to the internal form plug 502. The curl roller housing 506 can then be moved in an upward direction, as well as the internal form plug 502, to complete the process. This embodiment provides a two-step process for forming a curl in the neck of a metal bottle that provides a high degree of tolerance on the flat surface of the curl so that a reliable sealing edge is created.

Figure 6:
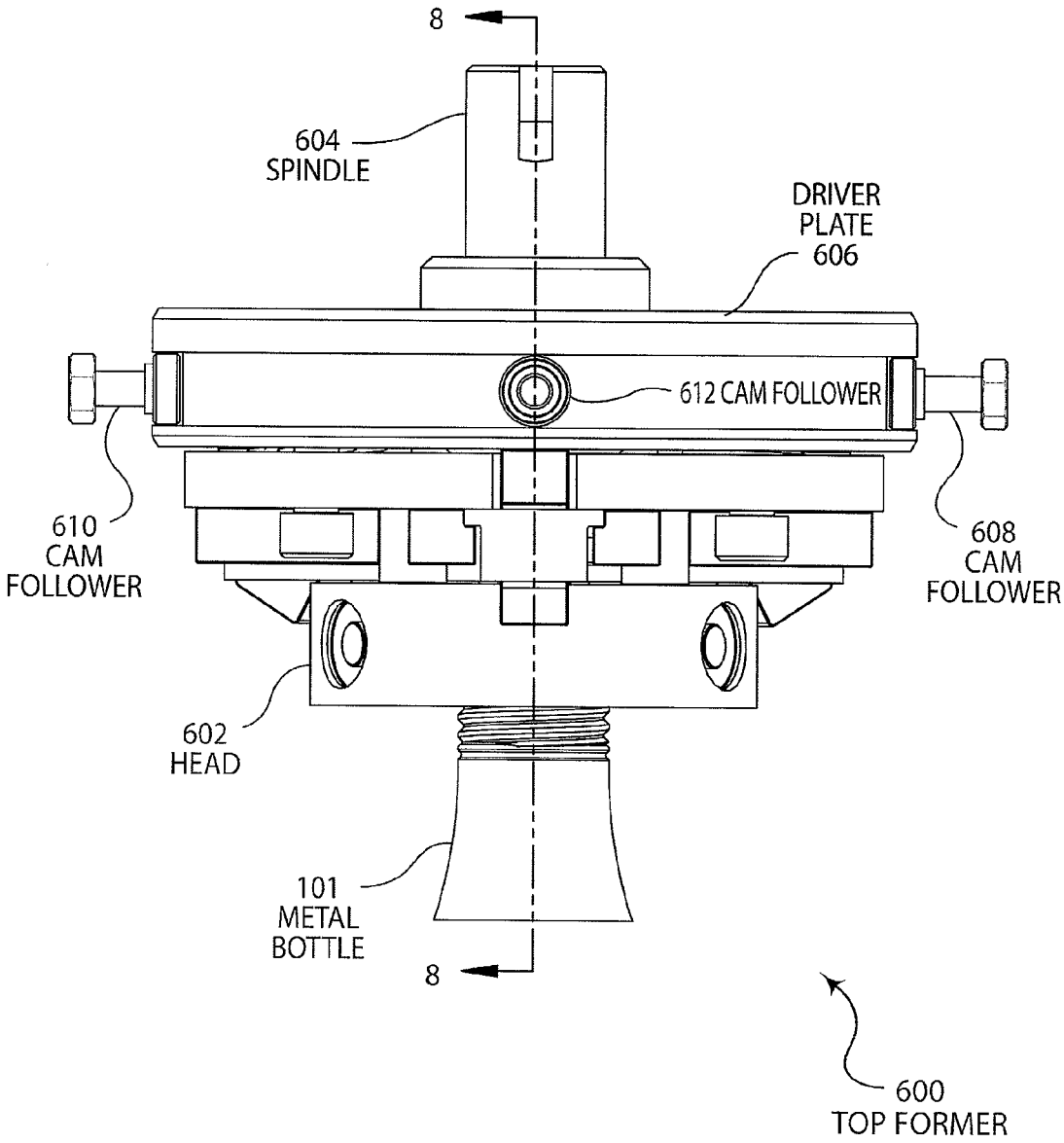
FIG. 6 is a side view of another embodiment of a top former.

FIG. 6 is a side view of another embodiment of a top former 600. Top former 600 is used to complete the curl in the neck of the bottle from the pre-curl curvature to the completed curl curvature at the top of the neck of the metal bottle 101. Top former 600 has a head 602 in which the top of the neck of the metal bottle 101 is placed. Spindle 604 is used to position the top former 600 over the bottle and apply an initial downward pressure on the neck of the metal bottle 101, as well as rotate to form the intermediate curl, using an intermediate curl roller 816 (FIG. 8). Top former 600 also includes a driver plate 606 that is driven in a vertically downward direction by cam followers 608, 610, 612, 702 (FIG. 7) to finish the curl, using a finish curl roller 814 (FIG. 8), as disclosed in more detail below.

Figure 7:
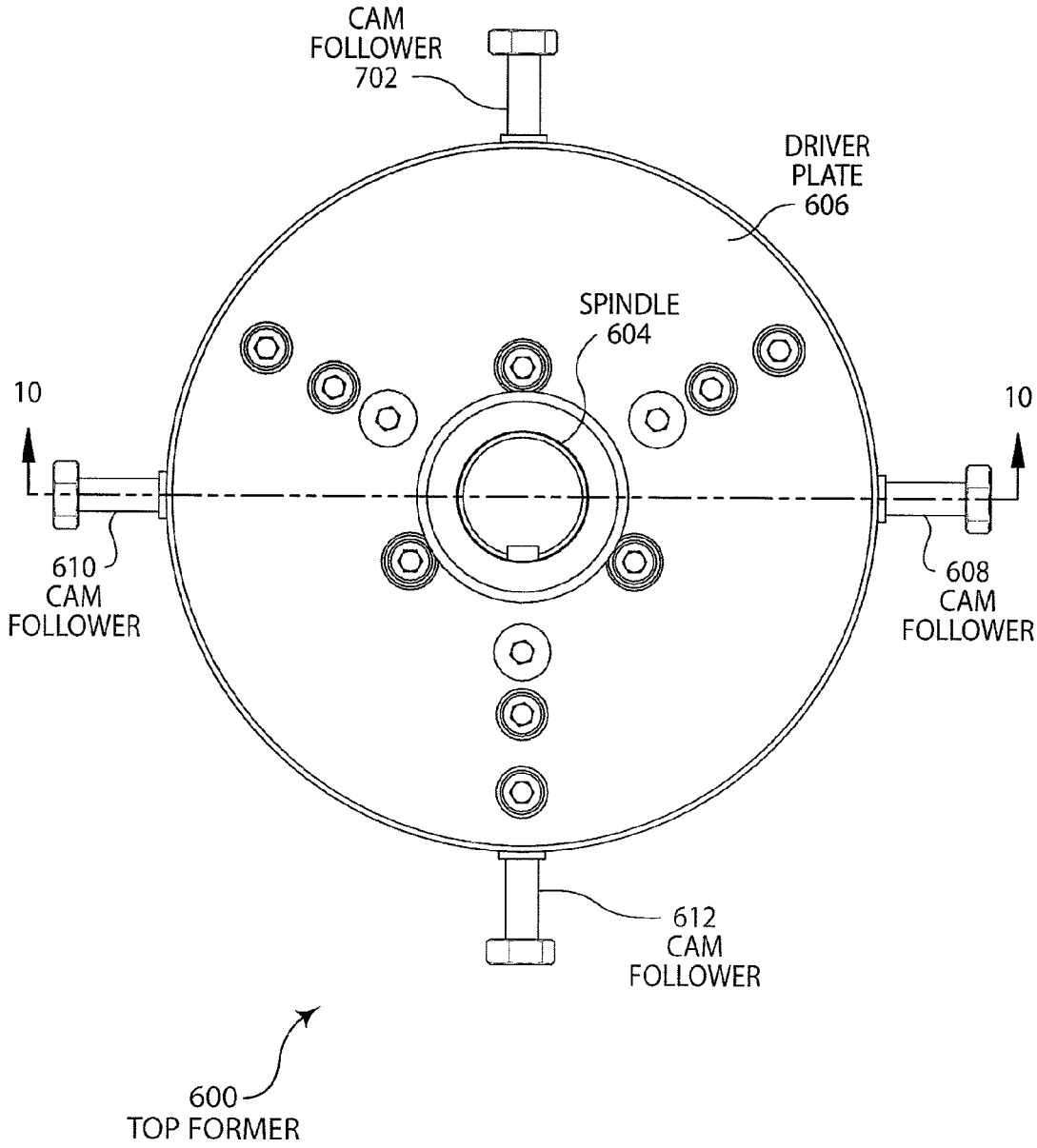
FIG. 7 is a top view of the top former of FIG. 6.
Figure 8:
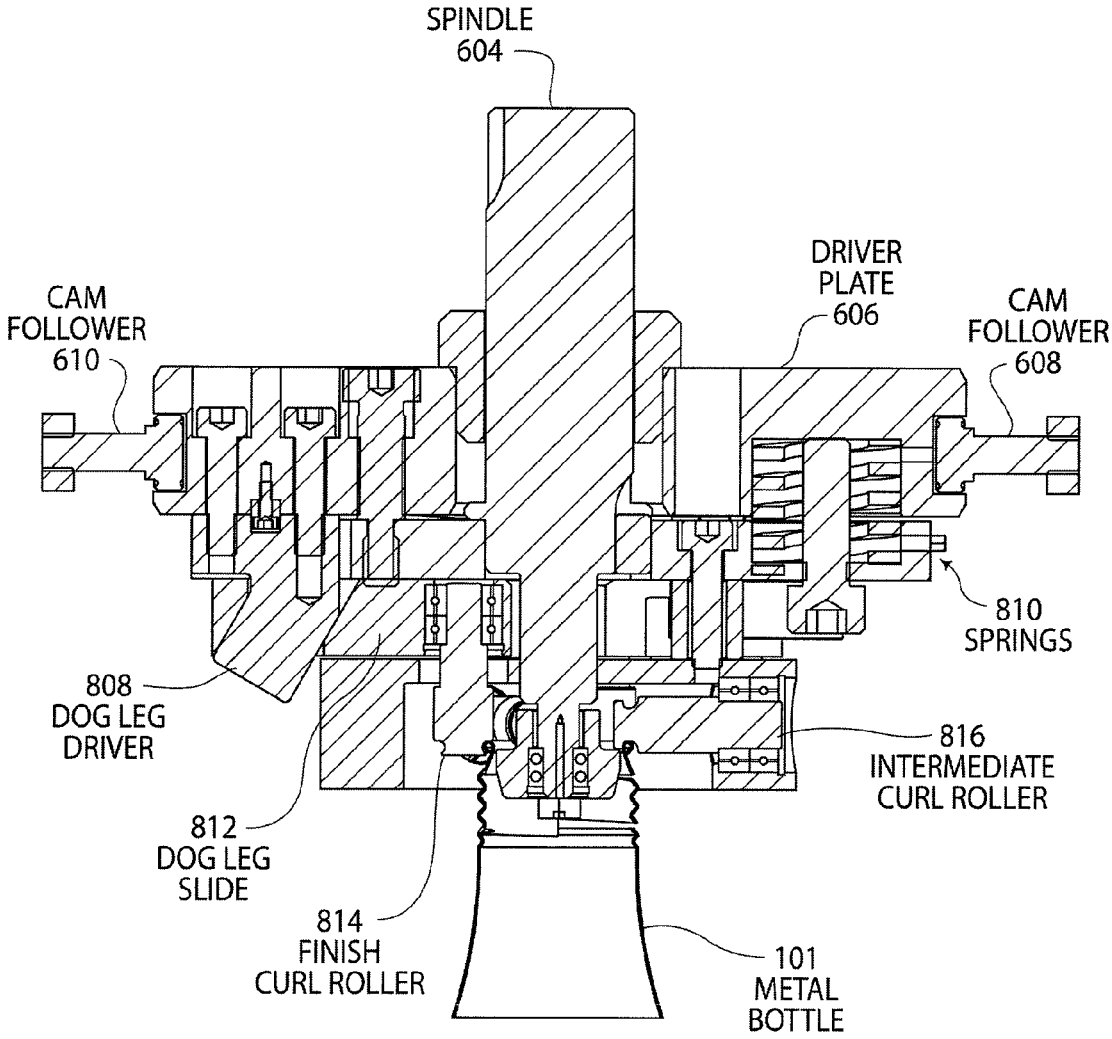
FIG. 8 is a cross-sectional view of the top former of FIG. 6.

FIG. 7 is a top view of the top former 600. As shown in FIG. 7, the cam followers 608, 610, 612 and 702 are placed evenly around the driver plate 606. FIG. 7 also illustrates the spindle 604.

Figure 9:
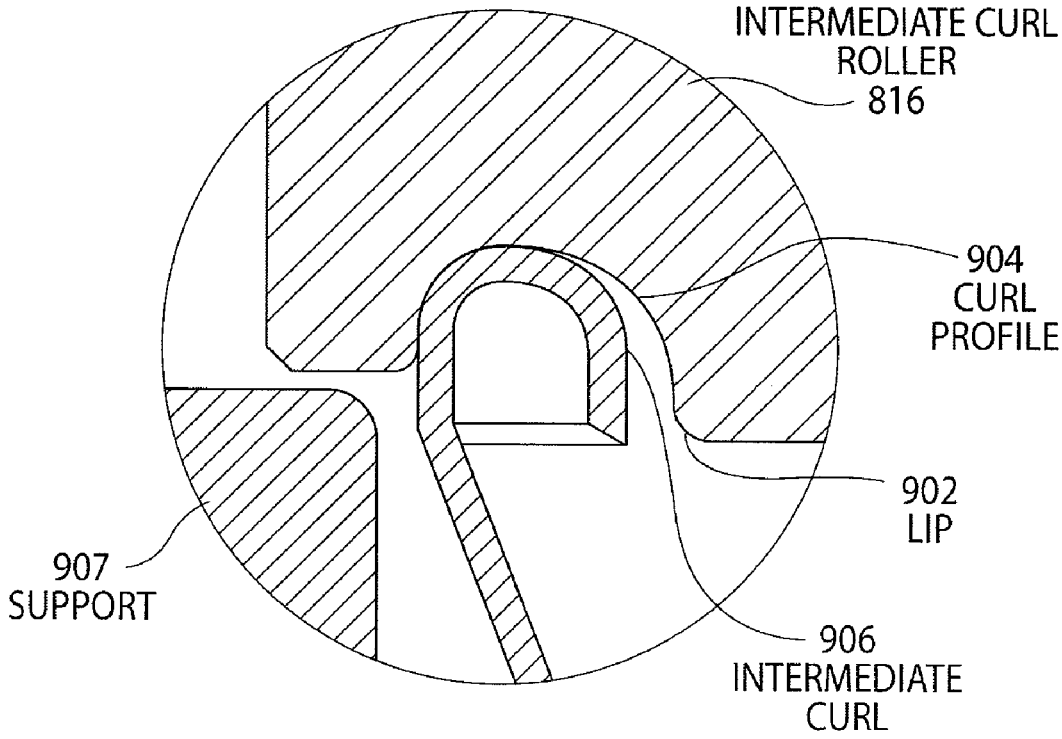
FIG. 9 is an exploded view of a portion of the drawing of FIG. 8.

FIG. 8 is a cross-sectional view of FIG. 6. FIG. 8 illustrates the spindle 604, the driver plate 606, the cam followers 608, 610 and the metal bottle 101. As also illustrated in FIG. 8, an intermediate curl roller 816 is used to create an intermediate curl in the pre-curl 314, that is illustrated in FIG. 4. The process of creating an intermediate curl is illustrated and described in more detail with respect to FIG. 9. The final curl is completed in finish curl roller 814, that is illustrated in more detail in FIG. 11. The intermediate curl roller operates by engaging the pre-curl 314 (FIG. 3) with a curl profile 904 in the intermediate curl roller 816, as illustrated in FIG. 9. The engagement of the pre-curl is accomplished by moving the spindle 904 in a downward direction, so that the curl profile 904 of the intermediate curl roller 906 causes the pre-curl to curl farther, in accordance with curl profile 904. Lip 902 guides the end of the curl 906, as illustrated in FIG. 9. A minimal amount of force is applied in a longitudinal downward direction by the spindle 904 to cause the curl 906 to conform to the curl profile 904 of the intermediate curl roller 816, so as to prevent crushing of the neck of the metal bottle.

Figure 11:
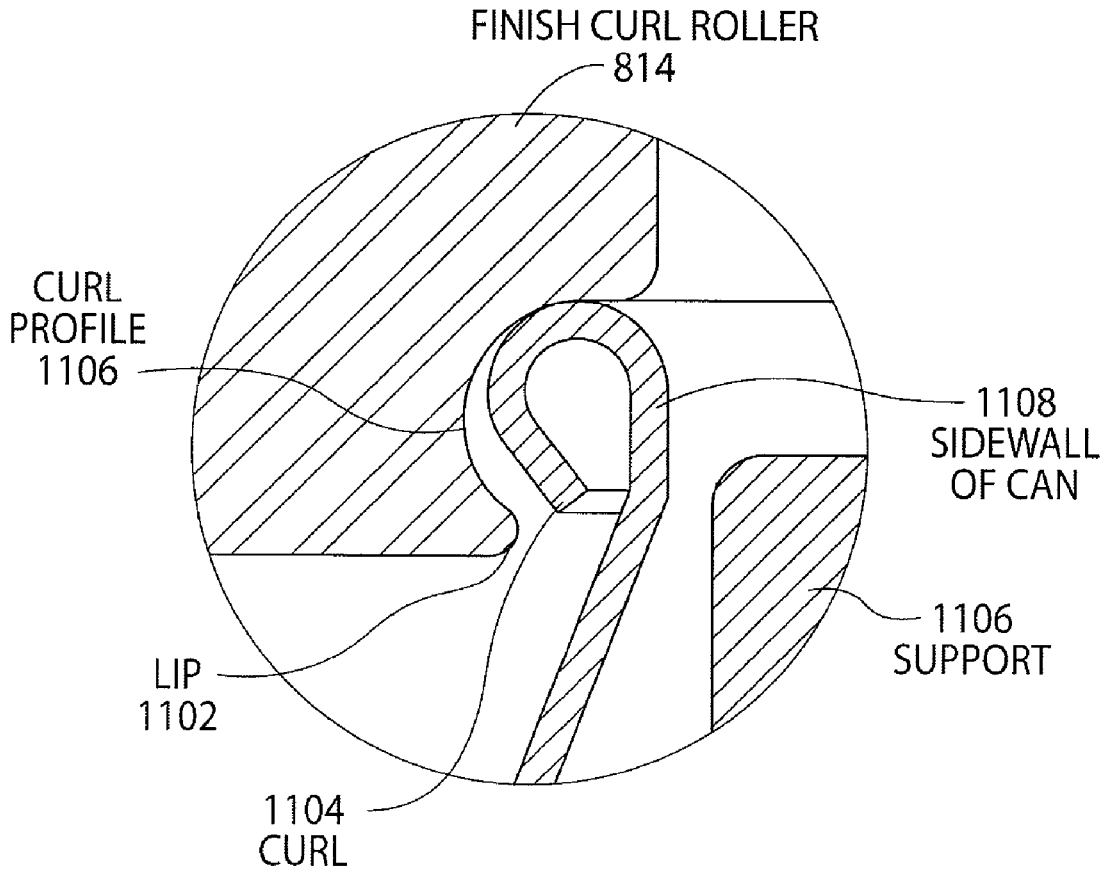
FIG. 11 is an exploded view of a portion of FIG. 8.

FIG. 8 also illustrates the finish curl roller 814. Finish curl roller 814 operates by applying pressure to curl 906 (FIG. 9) in a lateral or a horizontal direction, as shown in FIGS. 8 and 11, using the finish curl roller 814 that has a curl profile 1106. Lip 1102 (FIG. 11) engages the curl 1104 (FIG. 11) to force the end of the curl into the sidewall of the metal bottle 1108 (FIG. 11) to complete the curl. The finish curl roller 814, as disclosed in FIG. 8, is moved in a lateral or a horizontal direction in the following manner. A downward (longitudinal) force is applied to the cam followers 608, 610, 612 and 702, which moves the driver plate 606 in a downward direction, which, in turn, loads the springs 810. There are three dog leg drivers, such as dog leg driver 808, illustrated in FIG. 8, that move in a downward (longitudinal) direction in response to the force created by springs 810. Dog leg driver 808, as shown in FIG. 8, has a slanted surface that engages a slanted surface of dog leg slide 812. As the dog leg driver 808 moves in a downward direction, the dog leg slide 812 moves in a lateral or horizontal direction to the right, as shown in FIG. 8. The finish curl roller 814 is mounted in an opening in the dog leg slide 812, so that the finish curl roller 814 moves in a lateral or a horizontal direction to the right, to engage the curl 1104, as illustrated in FIG. 11. The spindle is then rotated to rotate the finish curl rollers to progressively finish the curls to create a completed curl as the finish rollers are progressively moved inwardly, in a lateral direction, towards the neck.

Various curl profiles can be used to form either partially closed curls or fully closed curls. As shown in FIG. 11, the curl 1104 is a partially closed curl. A fully closed curl can be formed by increasing the curl profile 1106 or moving the finish curl roller 814 to a more closed position and allowing lip 1102 to engage the curl and to close the curl to the sidewall of the can 1108. Additionally, the profile of the lip 1102 can be changed to produce either a closed curl or a partially open curl.

The advantage of the three-step process of completing the curl, including the formation of a pre-curl, is that the amount of vertical force is limited to the amount required to create the intermediate curl, which is less than any force required to crush the neck of the can in the longitudinal (vertical) direction. The primary force in completing the finished curl is directed in a lateral (horizontal) direction. The internal support plug includes a support 1106 that supports the neck of the can in a lateral (horizontal) direction, so that there is no damage to the neck of the metal bottle 101 when the lateral force is applied. Further, there are three total steps in forming the curl. The pre-curl step, the intermediate curl step, and the final curl step, as illustrated in FIGS. 3, 9 and 11, respectively. Again, the three-step process of curling the neck to a completed curl configuration allows for greater tolerances and less spring-back than if the process were completed in only one or two steps. If the full curl were to be formed in one operation, the formation of the full curl would have to be over-curled, to ensure that the curl was properly formed, as a result of spring-back. The tolerances of the top surface of a curl that is formed in a single operation may be less than desirable, as a result of the curl being over-formed or over-curled and then sprung back to a proper position. By using this three-step process, there is clearly less spring-back that occurs in the initial pre-curl process, the intermediate curl process, and the final curl process, as disclosed in FIGS. 3, 9 and 11, respectively. This three-step process provides for greater design capability and produces close tolerances as to the shape and flatness of the curl, which helps in the sealing process of sealing a cap to the top surface of the curl. Each of the progressive steps allows for modification and correction of imperfections in the previous step, which allows for even closer tolerances in the final curl process. Further, incremental working of the metal, that is already overworked, leads to less cracks and tends to allow for a more malleable metal in the curl that is produced as a result of less stress.

Figure 10:
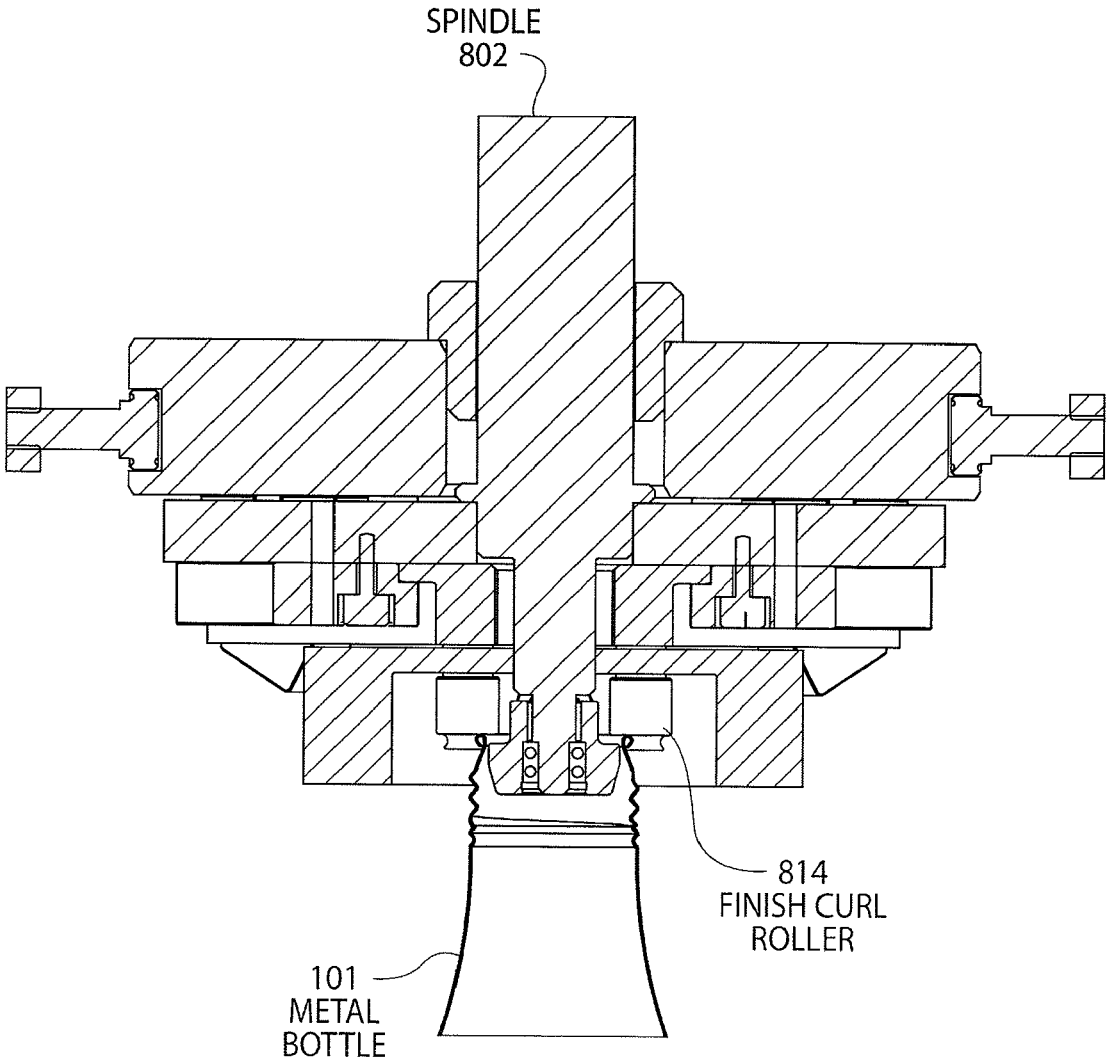
FIG. 10 is a cross-sectional view of FIG. 7.

FIG. 10 is a sectional view of FIG. 7. FIG. 10 illustrates the manner in which the finish curl roller 814 engages the intermediate curl 906 to form the final curl in the neck of the metal bottle 101. Finish curl rollers 814 progressively form the finish curl as a result of rotation of the spindle 802.

Figure 12:
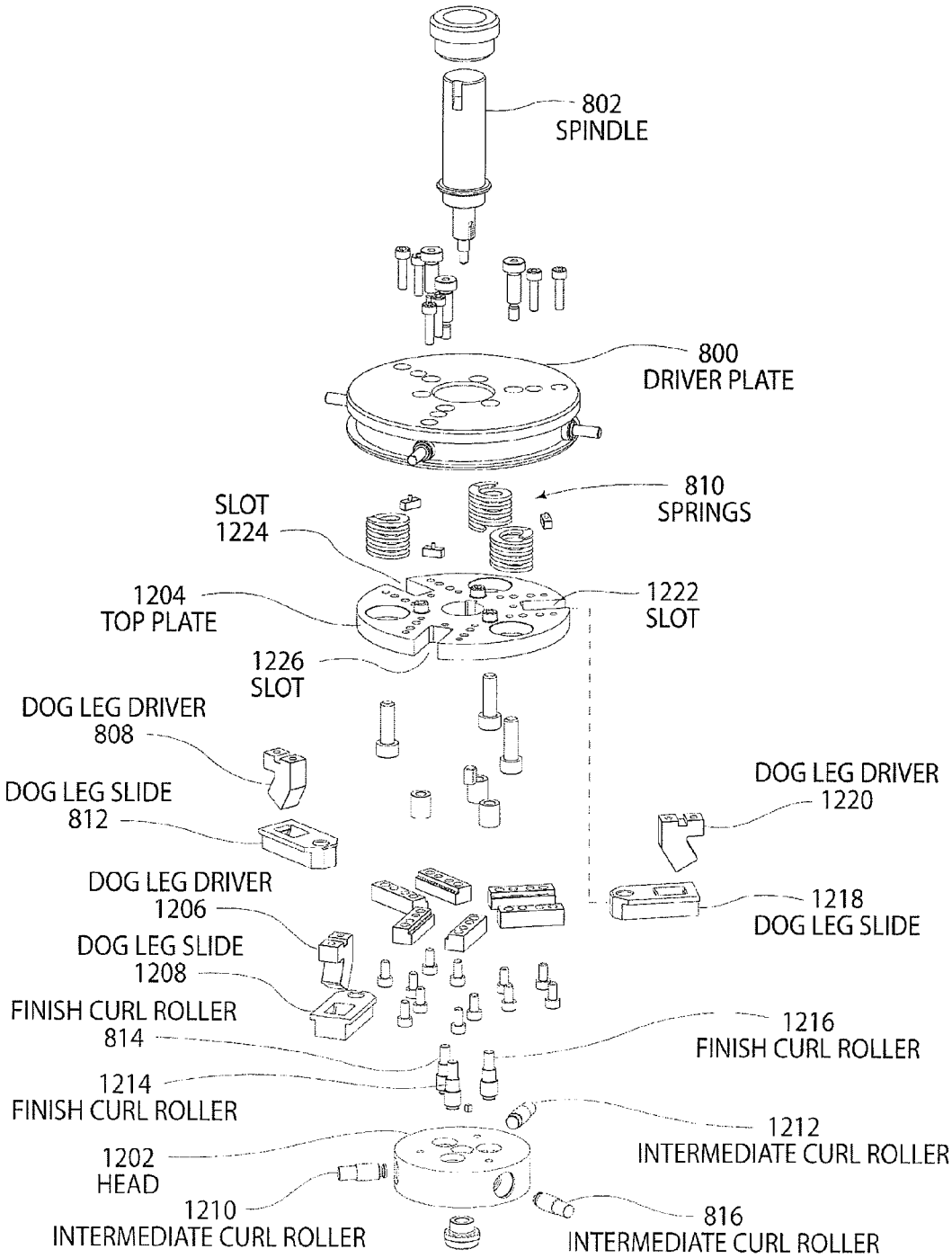
FIG. 12 is an assembly view of the top former illustrated in FIG. 6.

FIG. 12 is an exploded assembly drawing of the top former 600. As shown in FIG. 12, spindle 802 is inserted through the center opening in the drive plate 800. Springs 810 are mounted on the top plate 1204 to generate a force between the driver plate 800 and the top plate 1204. There are a series of three dog leg drivers 808, 1206 and 1220 that engage the dog leg slides 812, 1208 and 1218, respectively. As shown, the dog leg drivers and dog leg slides are mounted evenly around the top former 600 at 120°. The finish curl rollers 814, 1214 and 1216 are mounted in the cylindrical openings in dog leg slides 812, 1208 and 1218, respectively. The dog leg slides are mounted in the slots 1224, 1226 and 1222, respectively. The intermediate curl rollers 1210, 816 and 1212 are mounted evenly in openings in the head 1202 and interdisposed between the slots 1224, 1226 and 1222, so that there is a 60° difference between the intermediate curl rollers and the finish curl rollers. The geometry of the intermediate curl rollers and the finish curl rollers allows each of the intermediate curl rollers and each of the finish curl rollers to be evenly spaced and separated by equal distances between each other. This allows the top former 600 to be balanced and provide curl forming operations in an even and balanced manner, as the spindle 604 is rotated.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A process for forming a curl in a neck of a closeable container comprising:

providing an internal form plug having a pre-curl groove that substantially matches a desired shape for a pre-curl;

providing an external forming device that has a form roller having a lip that engages said pre-curl groove of said internal form plug;

placing said internal form plug into an opening in said neck of said closable container against an interior surface of said neck of said closable container at a position on said neck of said closable container where said pre-curl is to be formed;

moving said external forming device so that said lip of said form roller engages an exterior surface of said neck of said closable container and is substantially aligned with said pre-curl groove of internal form plug;

rotating said closable container and said form roller to form said pre-curl in said neck of said closable container;

cutting said neck of said closable container along said pre-curl;

inserting a second internal form plug in a longitudinal, inward direction in said neck of said closable container adjacent to said interior surface of said neck at a position that is displaced in said longitudinal, inward direction from said pre-curl;

aligning an intermediate curl groove on an intermediate curl roller with said pre-curl;

moving said intermediate curl roller in said longitudinal, inward direction so that said intermediate curl groove in said intermediate curl roller engages said pre-curl;

causing rotation between said closable container and said intermediate curl roller so that said intermediate curl groove progressively engages said pre-curl to form an intermediate curl in said neck;

aligning a final curl groove on a final curl roller with said intermediate curl;

moving said final curl roller in a lateral, transverse direction so that said final curl groove engages said intermediate curl;

causing rotation between said closable container and said final curl roller so that said final curl groove progressively engages said pre-curl to form a completed curl in said neck.

2. A system for forming a curl in a neck of a closable container comprising:

an internal form plug that is inserted in an opening of said neck of said closable container, said internal form plug having a pre-curl groove that substantially matches a desired shape of a pre-curl;

an external forming device that has a form roller with a lip that engages an exterior surface of said neck of said closable container and is aligned with said pre-curl groove to form a pre-curl in said neck of said closable container;

a cutter that engages said pre-curl and cuts said neck of said closable container at said pre-curl and removes said neck from said pre-curl;

an intermediate curl roller having an intermediate curl groove that is moved in a longitudinal direction along said neck to engage said pre-curl as said closable container is rotated so that said intermediate curl groove progressively engages said pre-curl to form an intermediate curl in said neck; and a final curl roller having a final curl groove that is moved in a lateral direction from said neck to engage said intermediate curl as said closable container is rotated so that said final curl groove progressively engages said pre-curl to form a complete curl in said neck.

* * * * *